US005950272A

United States Patent [19]

Kim et al.

[11] Patent Number: 5,950,272

[45] Date of Patent: Sep. 14, 1999

[54] VACUUM CLEANER HAVING AN APPARATUS FOR FIXING A CORD

[75] Inventors: Suk-Gu Kim, Seoul; Chang-Woo Son, Incheon, both of Rep. of Korea

[73] Assignee: Daewoo Electronics Co., Ltd., Seoul, Rep. of Korea

[21] Appl. No.: 08/997,384

[22] Filed: Dec. 23, 1997

[30] Foreign Application Priority Data

Apr. 30, 1997 [KR] Rep. of Korea ..... 97-16866

[51] Int. Cl.[6] ..... A47L 9/26

[52] U.S. Cl. ..... 15/323; 242/381.4; 242/385; 191/12 R

[58] Field of Search ..... 15/323; 242/381.1, 242/381.4, 385, 396.2; 191/12 R, 12.2 R, 12.4, 12.2 A

[56] References Cited

U.S. PATENT DOCUMENTS

| | | |
|---|---|---|
| 2,527,486 | 10/1950 | Osborn . |
| 2,937,396 | 5/1960 | Momberg et al. . |
| 3,999,640 | 12/1976 | Persson . |
| 4,106,165 | 8/1978 | Clowers . |

FOREIGN PATENT DOCUMENTS

| | | |
|---|---|---|
| 517 437 | 1/1940 | United Kingdom . |
| 1 159 810 | 7/1969 | United Kingdom . |
| 1 478 005 | 6/1977 | United Kingdom . |

*Primary Examiner*—Robert Warden
*Assistant Examiner*—Jennifer C. McNeil
*Attorney, Agent, or Firm*—Pillsbury Madison & Sutro LLP

[57] ABSTRACT

A vacuum cleaner having a cord fixing apparatus. The vacuum cleaner has a body having a rear wall having an opening, a brush assembly connected to the body through a flexible hose and making contact with a floor, for sucking dust and impurities, a blower assembly which is installed at an inner side of the body, for generating a suction force, an extensible cord for supplying an external electric power to the blower assembly, a reel installed at an inner side of the body, for winding the cord, a rectangular-shaped plate for fixing the cord, a fixing rib for hingedly supporting the rectangular-shaped plate, an elastic material for biasing the rectangular-shaped plate to allow the rectangular-shaped plate to make contact with the cord, and a supporting rib for supporting the elastic material to allow the elastic material to apply a biasing force to the rectangular-shaped plate. The cord fixing apparatus has a simple structure, and when the cord is withdrawn out of the body, the cord is easily fixed to the cord fixing apparatus.

10 Claims, 7 Drawing Sheets

VACUUM CLEANER HAVING AN APPARATUS FOR FIXING A CORD

BACKGROUND OF THE INVENTION

1. Field of the Invention

The present invention relates to a vacuum cleaner, and more particularly to an apparatus for fixing a cord of a vacuum cleaner.

2. Description of the Prior Art

A vacuum cleaner is an apparatus for sucking dust and impurities by suction which is generated by a blower assembly installed in a body of the vacuum cleaner.

The vacuum cleaner comprises a body having wheels mounted at both sides thereof, a dust collecting chamber which is installed at an inside of the body for collecting dust and impurities, a trash bag which is installed at an inside of a dust collecting chamber, a flexible hose which is connected to an inlet hole of a dust collecting chamber, a brush head assembly which makes contact with a floor, for sucking dust and impurities, and a cord for transmitting an electric power to the vacuum cleaner.

Generally, the vacuum cleaner is powered by a direct current supplied from a battery accommodated in the vacuum cleaner or by an alternating current which is supplied through a power generator. Accordingly, in the vacuum cleaner which is powered by the alternating current, it is necessary to use a power cord which is either fixedly or releasably coupled to the vacuum cleaner to supply electric power to the vacuum cleaner.

FIG. 1. illustrates a structure of a canister type vacuum cleaner 100. The vacuum cleaner 100 comprises a body 110, a brush assembly 120 which is separated from the body 110, and an extension bar 130 and a flexible hose 140 connecting the brush assembly 120 with the body 110. A cord winder (not shown) for winding and extracting the cord (not shown) is installed at an inner side of the body 110.

FIG. 2 illustrates a conventional vacuum cleaner having the cord winder 200. As illustrated in FIG. 2, the cord winder 200 includes a reel 210 and is installed within a reel chamber 204 defined in a body 110 of the vacuum cleaner 100. A torsion spring member (not shown) is installed within the reel 210 for applying a clock-wise biasing force to reel 210.

A button 220 is provided to a rear end portion of an upper surface of body 110. The button 220 has an extended upper portion and is integrally formed with the upper surface of body 110, and has a curved rear portion 220 forming one portion of the rear surface of the body 110.

A pressing lever 240 extends in a downward direction from a lower portion of the button 220. The pressing lever 240 makes contact with an upper surface of an actuator rod 260 which is installed at a lower portion of the pressing lever 240. A projection portion 252 extends in the downward direction with respect to an upper portion of the body 310. A hinge 250 is installed at a front side of the pressing lever 240 so as to permit the button 220 to be swung. A compression coil spring 230 is installed at a rear portion of the pressing lever 240 for elastically supporting the button 220 in the upward and downward directions. The actuating rod 260 is placed at a lower portion of a ceiling of the reel chamber 204. The actuating rod 260 is coupled to a projection portion 264 which is integrally formed at a lower portion of the ceiling of the reel chamber 204, by the hinge 263. A circular stopper 270 is mounted at an end portion of the actuator rod 260. The circular stopper 270 is rotatably coupled to the actuator rod 260 by a stopper pin 272 through the circular stopper 270.

A friction wall 280 making contact with the circular stopper 270 is installed at an inner side of the rear portion of the reel chamber 204 and is spaced apart from the reel 210 for winding the cord 290. The circular stopper 270 is placed between the outer periphery of reel 210 and friction wall 280 to prevent a revolution of the cord winder 200.

As illustrated, when the user stops the pressing of the button 220, the button 220 is maintained at its uppermost position by means of the biasing force of the compression coil spring 230, and an end portion of the stopper rod 260 ascends. At this time, the circular stopper 270 comes into contact with the friction wall 280 and the outer periphery of the reel 210 simultaneously, thereby preventing the rotation of the reel 210.

When the user presses button 220, the pressing rod 240 pushes the end portion of the actuator rod 260, and the circular stopper 270 mounted at an end portion of the actuator rod 260 ascends. Accordingly, a rigid connection between the friction wall 280 and the reel 210 is released. At this time, the reel torsion spring (not shown) exerts its clock-wise biasing force upon the reel 210. Therefore, the reel 210 is rotated by the clock-wise biasing force of the reel torsion spring so as to wind the cord 290 on the reel 210.

When the user stops pressing the button 220 again, the button 220 ascends by the biasing force of the compression coil spring 230. Accordingly, the end portion of the actuator rod 260 ascends. At this time, the circular stopper 270 comes into contact with the friction wall 280 and the outer periphery of the reel 210 simultaneously, thereby preventing the rotation of the reel 210.

U.S. Pat. No. 3,999,640 which is issued to Gunnar Ingemar and entitled "Cord Winding Structure" discloses a vacuum cleaner which is similar to the above conventional vacuum cleaner.

Ingemar's vacuum cleaners a cord fixing apparatus comprising a pressing button formed at an upper surface of the reel chamber, a link arm connected with the pressing button, a plate adhering to the link arm, and a rotating portion adhering at an end portion of the plate. When the user presses the pressing button, the plate descends in the downward direction by the link. At this time, the link arm connected with the plate descends in the downward direction. Accordingly, a gap between the plate and link arm is enlarged so that the cord can be withdrawn.

However, in case of using the cord fixing apparatus, since a structure of the cord winder is complicated, it takes a long time to assemble the cord fixing apparatus, and a lot of components are required, so the manufacturing cost thereof is increased. Furthermore, even when one of the components thereof is broken, the cord winder cannot be used.

SUMMARY OF THE INVENTION

Accordingly, the present invention has been made to solve the foregoing problem, and an object of the present invention is to provide a cord fixing apparatus of a vacuum cleaner which has a simple structure and by which a cord is easily fixed.

In order to achieve the above object, the present invention provides a vacuum cleaner having a cord fixing apparatus, the vacuum cleaner comprising:

- a body having a rear wall having an opening;
- a brush assembly connected to the body through a flexible hose and making contact with a floor, for sucking dust and impurities;
- a blower assembly which is installed at an inner side of the body, for generating a suction force;

an extensible cord for supplying an external electric power to the blower assembly;

a reel installed at an inner side of the body, for winding the cord;

a rectangular-shaped plate for fixing the cord, the rectangular-shaped plate frictionally engaged with the cord;

a fixing rib for hingedly supporting the rectangular-shaped plate;

an elastic material for biasing the rectangular-shaped plate to allow the rectangular-shaped plate to make contact with the cord; and a supporting rib for supporting the elastic material to allow the elastic material to apply a biasing force to the rectangular-shaped plate.

According to the preferred embodiment of the present invention, a bottom portion of the rectangular-shaped plate makes contact with a bottom wall of the body and a top portion of the rectangular-shaped plate passes through the opening so that the rectangular-shaped plate is arranged to be inclined with respect to the bottom wall of the body. A hole for withdrawing the cord is formed between the top portion of the rectangular-shaped plate and an upper portion of the opening.

The rectangular-shaped plate is integrally formed at a lower portion of a first side thereof with a first hinge pin, and is integrally formed at a second side thereof which is opposite to the first side with a second hinge pin. And, a semicircular concave portion is formed at a predetermined position of the top portion of the rectangular-shaped plate, for easily releasing the rectangular-shaped plate from the cord.

Meanwhile, the preferred embodiment for releasing the connection between the rectangular-shaped plate and cord is described. That is, the rectangular-shaped plate further comprises a knob protrudingly formed at an upper portion of a front side of the rectangular-shaped plate to release a friction between the rectangular-shaped plate and the cord.

The fixing rib includes a first fixing rib which is fixed to the bottom wall of the body and a second fixing rib spaced at a predetermined distance apart from the first fixing rib, and the rectangular-shaped plate is hingedly disposed therebetween.

The first and second fixing ribs have a first pin hole and a second pin hole, respectively, at each end portion thereof. The first and the second pins are hingedly inserted into the first and second pin holes, respectively.

The supporting rib is formed at the bottom wall of the body and spaced by a predetermined distance apart from the rectangular-shaped plate, and a first projection is integrally formed at a front side of the supporting rib.

The elastic material includes a spring having a first end portion being fixed to a second projection provided at a rear surface of the rectangular-shaped plate and a second end portion being fixed to the first projection. The first end portion is opposite the second end portion.

The upper portion of the opening is inclined laterally in left and right directions from a center thereof by a predetermined angle, respectively, and the cord is positioned at the center of the opening.

BRIEF DESCRIPTION OF THE DRAWINGS

The above object and advantages of the present invention will become more apparent by describing in detail preferred embodiments thereof with reference to the attached drawings, in which.

DETAILED DESCRIPTION OF THE INVENTION

Hereinafter, a preferred embodiment of the present invention will be explained in more detail with reference to the accompanying drawings.

Figure 1:
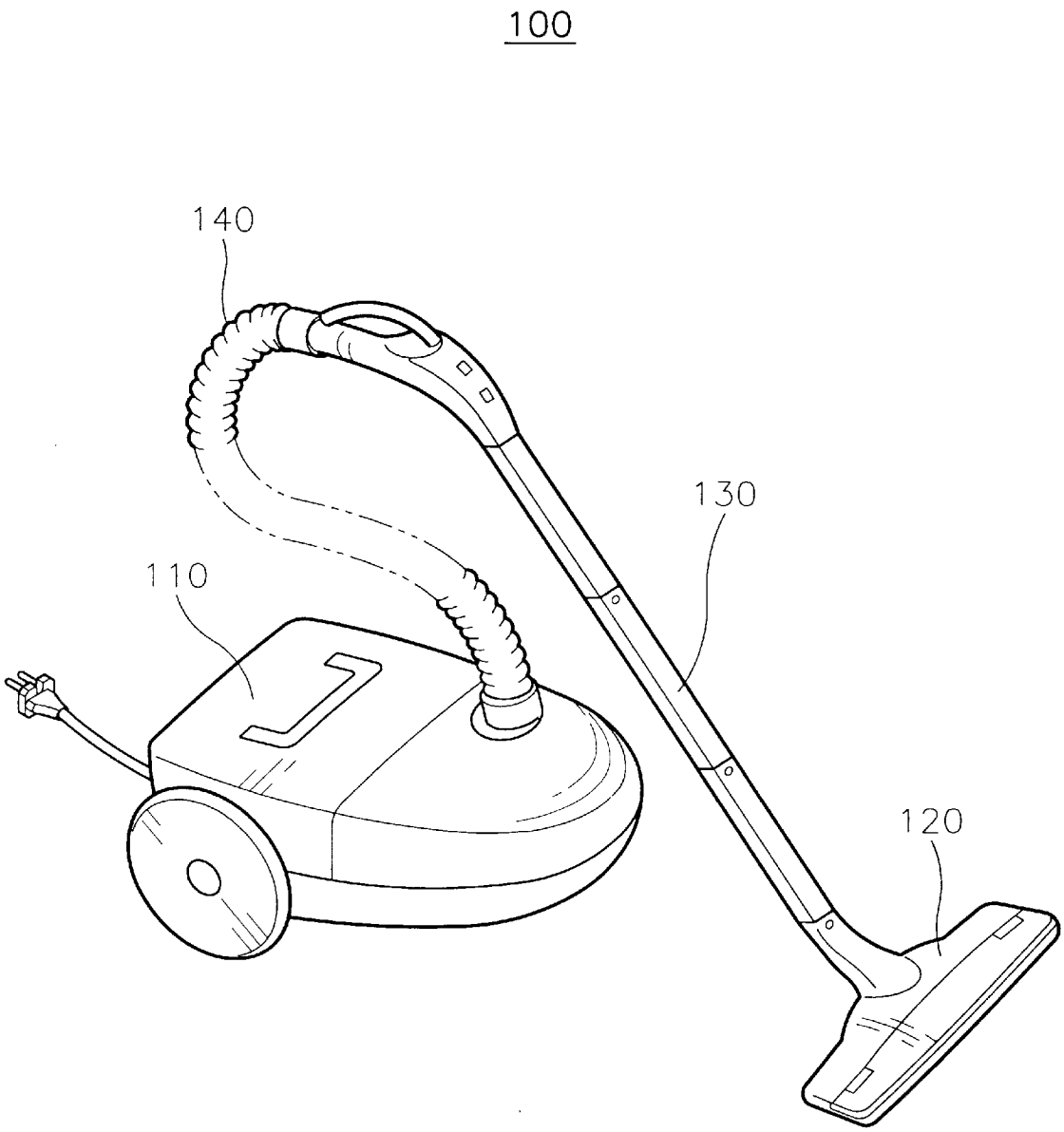
FIG. 1 (PRIOR ART)
FIG. 1 is a perspective view showing a structure of a conventional vacuum cleaner.
Figure 2:
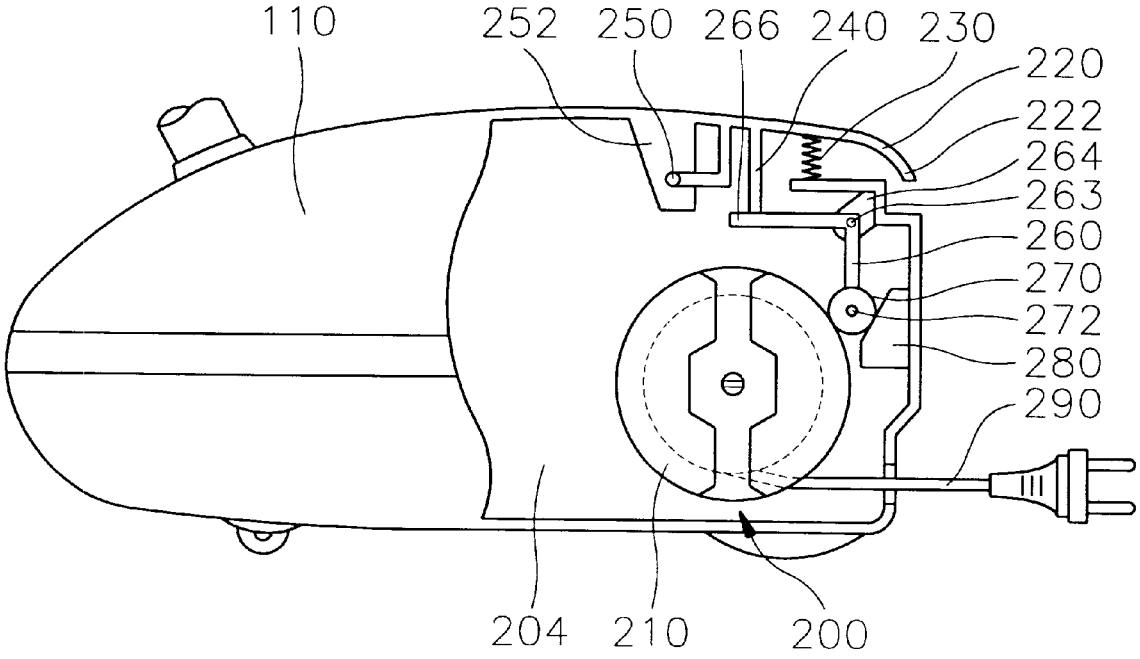
FIG. 2 (PRIOR ART)
FIG. 2 is a sectional view showing a structure of a cord fixing apparatus of the vacuum cleaner illustrated in FIG. 1.
Figure 3:
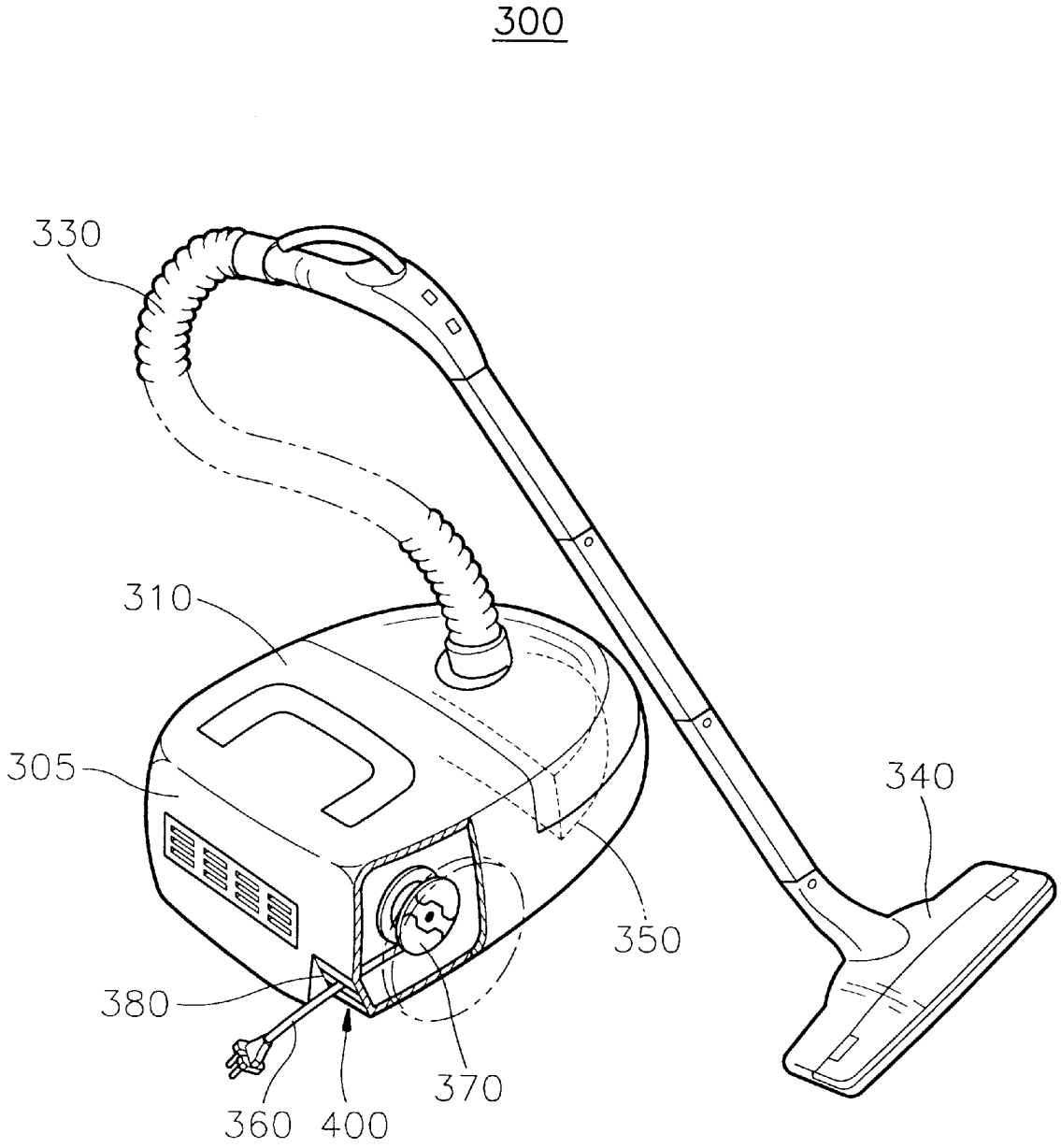
FIG. 3 is a perspective view showing the structure of a vacuum cleaner according to the present invention.

FIG. 3 illustrates a cord fixing apparatus 400 of a vacuum cleaner in accordance with the present invention. As illustrated in FIG. 3, the vacuum cleaner has a body 310 having a rear wall 305 having an opening 380, a brush assembly 340 connected to the body 310 through a flexible hose 330 and making contact with a floor, for sucking dust and impurities, a blower assembly 350 which is installed at an inner side of the body 310, for generating a suction force, an extensible cord 360 for supplying an external electric power to the blower assembly 350, and a cord winder 370 installed at an inner side of the body 310, for winding the cord 360, and a cord fixing apparatus 400 for fixing the cord 360.

Figure 4:
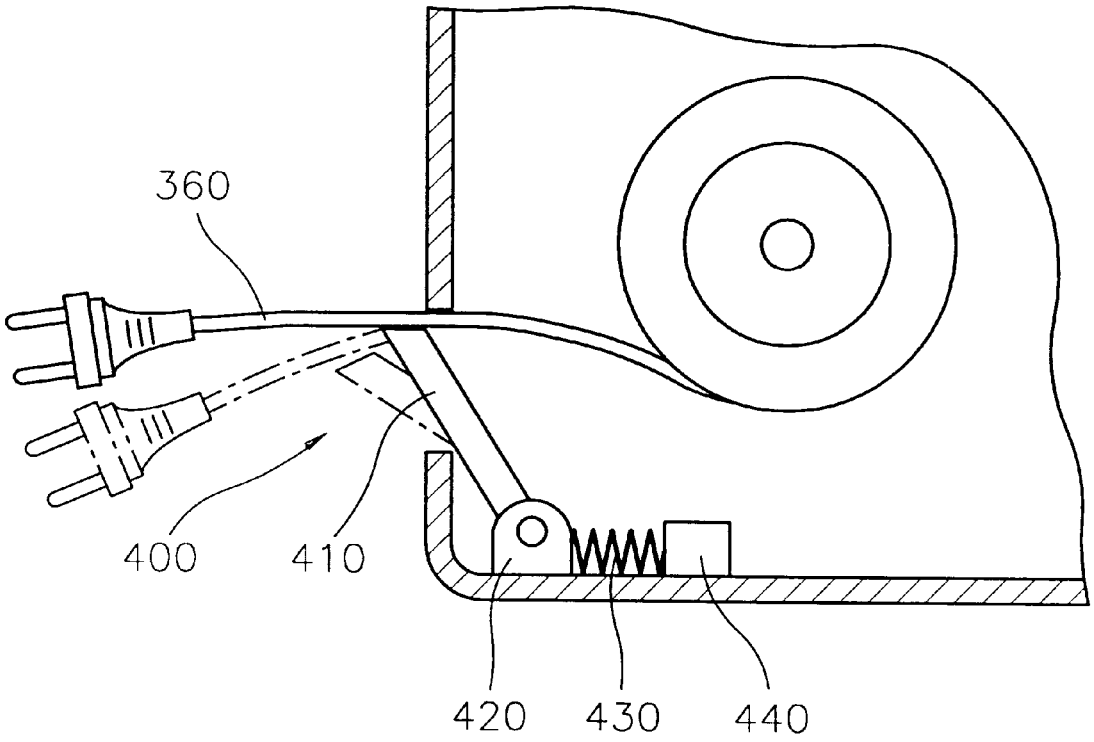
FIG. 4 is a sectional view showing a structure of the cord fixing apparatus according to the present invention.

As illustrated in FIG. 4, the cord fixing apparatus 400 is provided with a rectangular-shaped plate 410 for fixing the cord 360, and the rectangular-shaped plate 410 being frictionally engaged with the cord 360, a fixing rib 420 for hingedly supporting the rectangular-shaped plate 410, an elastic material 430 for biasing the rectangular-shaped plate 410 to allow the rectangular-shaped plate 410 to make contact with the cord 360, and a supporting rib 440 for supporting the elastic material 430 to allow the elastic material 430 to apply a biasing force to the rectangular-shaped plate 410.

Figure 5:
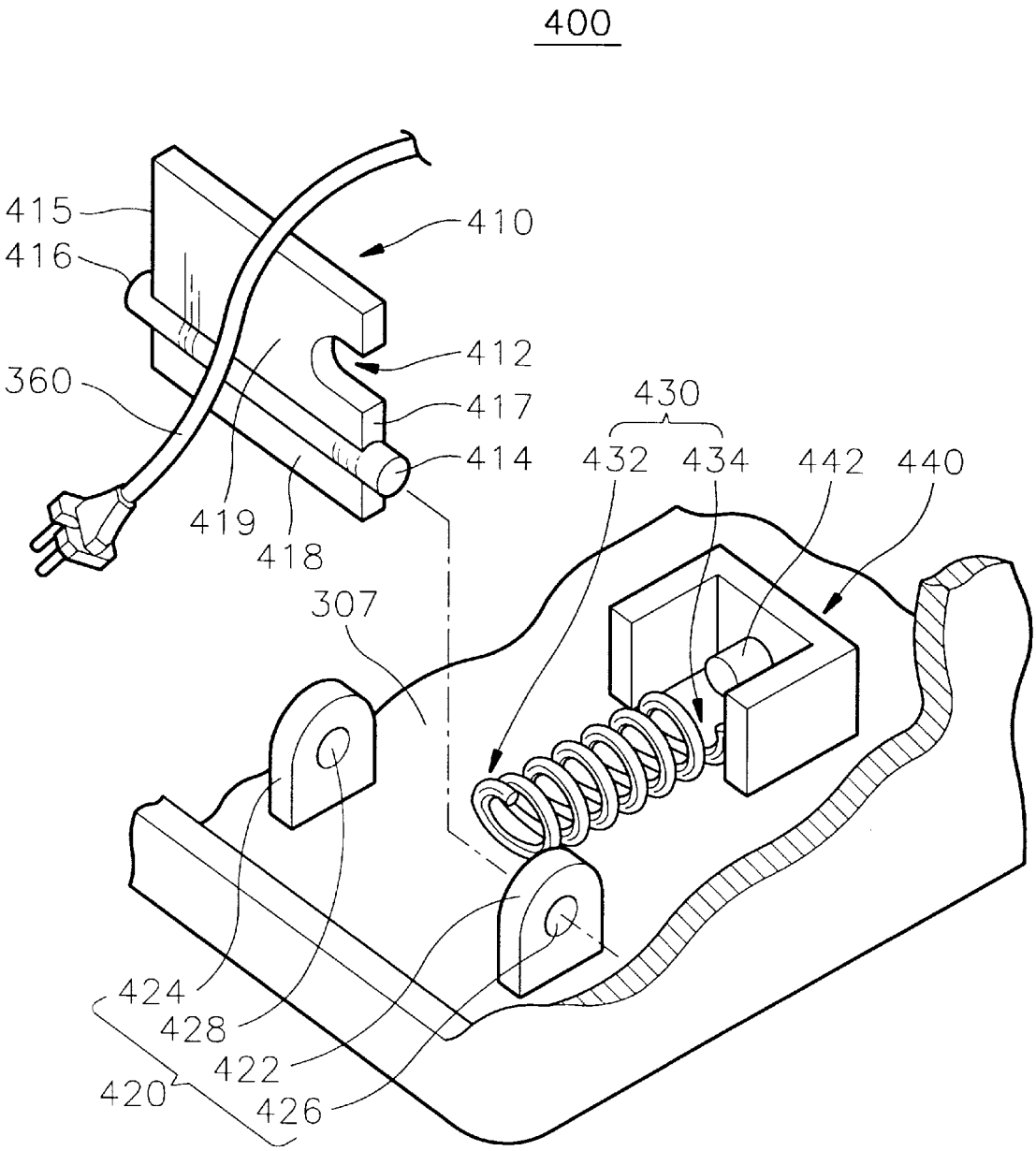
FIG. 5 is a partially disassembled perspective view for showing a disassembled structure of the cord fixing apparatus according to the present invention.
Figure 6:
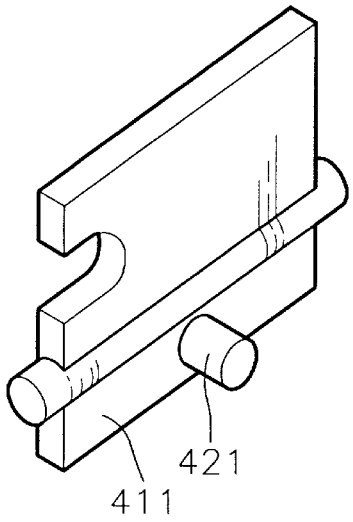
FIG. 6 is an enlarged view showing a rectangular-shaped plate of the cord fixing apparatus illustrated in FIG. 5.

FIGS. 5 and 6 are partially disassembled perspective views enlargedly showing the cord fixing apparatus according to the present invention. As illustrated in FIGS. 5 and 6, the rectangular-shaped plate is placed at an inner portion of the opening. A bottom portion 418 of the rectangular-shaped plate 410 makes contact with a bottom wall 307 of the body 310, and a top portion 419 of the rectangular-shaped plate 410 passes through the opening (not shown) so that the rectangular-shaped plate 410 is arranged to be inclined with respect to a bottom wall 307 of the body 310. An opening for withdrawing the cord 360 is formed between the top portion 419 of the rectangular-shaped plate 410 and an upper portion of the opening. And the cord 360 can be withdrawn through the opening.

The rectangular-shaped plate 410 is integrally formed at a lower portion 418 of a first side 415 thereof with a first hinge pin 416, and is integrally formed at a second side 417 thereof which is opposite to the first side 415 with a second hinge pin 414. A semicircular concave portion 412 is formed at a predetermined position of the top portion 419 of the rectangular-shaped plate 410. In case of releasing the cord 360, the user grips the semicircular concave portion 412 and rotates the rectangular-shaped plate 410 in the forward direction. At this time, the gap between the rectangular-shaped plate 410 and the cord 360 is enlarged. Accordingly, a connection between the rectangular-shaped plate 410 and the cord 360 is broken and the cord 360 can be withdrawn out of the body 310.

The fixing rib 420 includes a first fixing rib 424 which is fixed to the bottom wall 307 of the body 310 and a second fixing rib 422 spaced at a predetermined distance apart from the first fixing rib 424. The first and second fixing ribs 424 and 422 have a first pin hole 428 and a second pin hole 426, respectively, at each end portion thereof, and the first and the second pins 416 and 414 are hingedly inserted into the first and second pin holes 428 and 426, respectively. The rectangular-shaped plate 410 is hingedly disposed between the first pin hole 428 and the second pin hole 426. The supporting rib 440 is formed at the bottom wall 307 of the body 310 and spaced by a predetermined distance apart from the rectangular-shaped plate 410. The first projection 442 is integrally formed at a front side of the supporting rib 440, for supporting the elastic material.

The elastic material 430 has a first end portion 432 being fixed to a second projection 421 provided at a rear surface 411 of the rectangular-shaped plate 410, and a second end portion 434 being fixed to the first projection 442.

Figure 7:
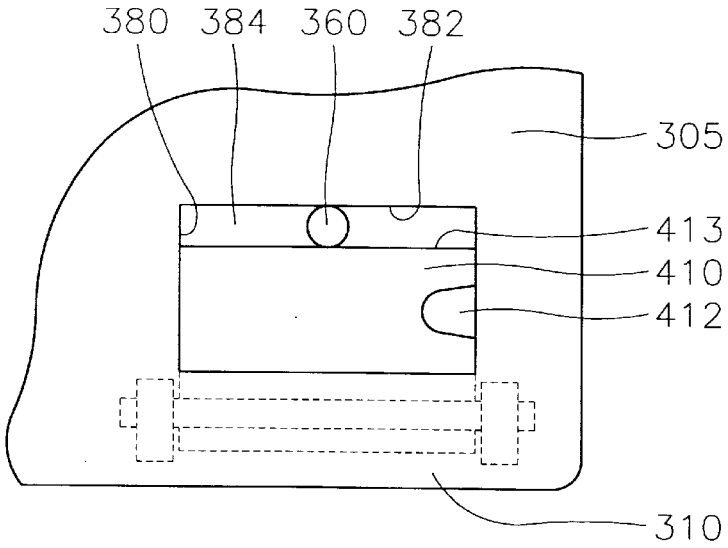
FIG. 7 is a front view showing a front side of the cord fixing apparatus according to the present invention.

FIG. 7 is a front view showing the front side of the cord fixing apparatus. As illustrated, the rectangular-shaped plate 410 is placed at an inner side of the opening 380 formed at a rear wall 305 of the body 310. The opening 380 for withdrawing the cord 360 is formed between the top portion 413 of the rectangular-shaped plate 410 and an upper portion 382 of the opening 380. The semicircular concave 412 is formed at an end portion of the rectangular-shaped plate 410, for rotating the rectangular-shaped plate 410.

Figure 8:
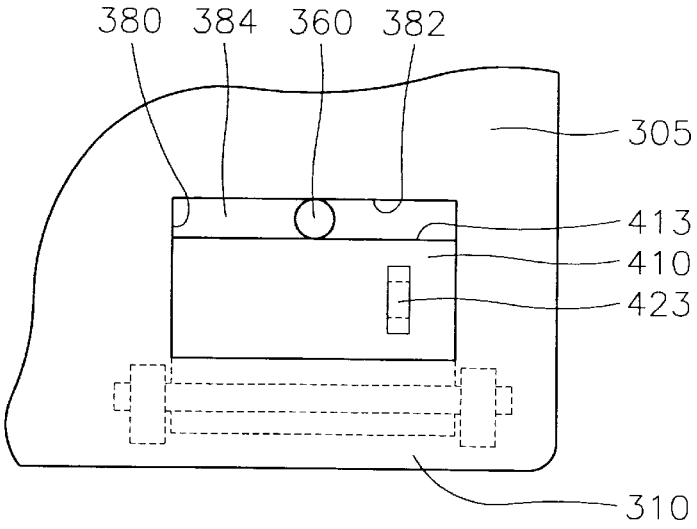
FIG. 8 is a front view showing a knob formed at the rectangular-shaped plate of the vacuum cleaner according to the present invention.

FIG. 8 illustrates a preferred embodiment of the cord fixing apparatus according to the invention. As illustrated, a knob 423 is protrudingly formed at the front side of the rectangular-shaped plate 410. Like the case of the semicircular concave 412 (illustrated in FIG. 7) in case of releasing the cord 360 fixed by the rectangular-shaped plate 410, the user grips the knob 423 and rotates the rectangular-shaped plate 410 in the forward direction. At this time, the gap between the rectangular-shaped plate 410 and the cord 360 is enlarged. Accordingly, the connection between the rectangular-shaped plate 410 and the cord 360 is released, so the cord 360 can be withdrawn out of the body 310.

Figure 9:
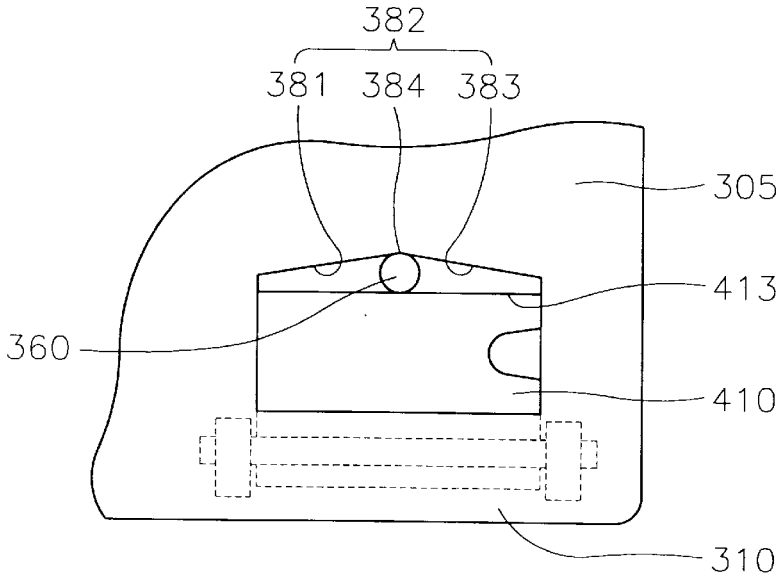
FIG. 9 is a front view showing a cord fixing apparatus of a vacuum cleaner according to a preferred embodiment of the present invention.

FIG. 9 illustrates a preferred embodiment of the cord fixing apparatus according to the invention. As illustrated, the upper portion 382 of the opening 380 has a first and a second inclined surface 381 and 383 inclined downward in a rightward and leftward direction from the center portion 384 thereof. The top portion 413 of the rectangular-shaped plate 410 is horizontal. At this time, and the cord 360 is placed between the rectangular-shaped plate 410 and the upper portion 382 of the opening 380. Accordingly, the cord 360 can be placed at the center portion 384 of the opening 380.

Hereinafter, the function of the cord fixing apparatus of the vacuum cleaner according to the invention will be explained.

As illustrated in FIG. 5, the cord fixing apparatus 400 includes the rectangular-shaped plate 410 for fixing and releasing the cord 360. A elastic material 430 is disposed at a bottom portion 418 of the rectangular-shaped plate 410, for applying a biasing force to the rectangular-shaped plate 410. And, the elastic material 430 is supported by the supporting rib 440 formed at a rear portion of the fixing rib 420.

The elastic material 430 always exerts a clock-wise biasing force upon the rectangular-shaped plate 410. Accordingly, the top portion 419 of the rectangular-shaped plate 410 makes contact with the upper portion(not shown) of the opening(not shown). The cord 360 is placed between the upper portion of the opening and the rectangular-shaped plate 410. Therefore, the cord 360 is fixed by the friction force between the rectangular-shaped plate 410 and the upper portion of the opening.

On the other hand, when the user winds the cord 360, firstly, the user grips the semicircular concave 412 formed at a top portion of the rectangular-shaped plate 410. And then, the user rotates the rectangular-shaped plate 410 in the forward direction. Accordingly, the gap between the top portion 419 and the upper portion(not shown) is enlarged, so the cord 360 can be wound. At this time, the elastic material 430 disposed at the bottom portion 418 of the rectangular-shaped plate 410 is compressed.

When the user withdraws the cord 360 again, first, the user grips the cord 360 and pulls the cord 360 to withdraw the cord 360 out of the body 310. At this time, the rectangular-shaped plate 410 makes contact with the surface of the cord 360, and the rectangular-shaped plate 410 is rotated in the counterclockwise direction by the friction applied by the cord 360. Accordingly, the cord 360 can be withdrawn out of the body 310.

As described through the preffered embodiment, the cord fixing apparatus of a vacuum cleaner has a simple structure and when the cord is withdrawn out of the body, the cord is easily fixed to the cord fixing apparatus.

While the present invention has been particularly shown and described with reference to a preferred embodiment thereof, it will be understood by those skilled in the art that various changes in form and detail may be effected therein without departing from the spirit and scope of the invention as defined by the appended claims.

What is claimed is:

1. A vacuum cleaner comprising:

a body having a rear wall having an opening;

a brush assembly connected to the body through a flexible hose and making contact with a floor, for sucking dust and impurities;

a blower assembly which is installed at an inner side of the body, for generating suction force;

an extensible cord for supplying an external electric power to the blower assembly;

a reel installed at an inner side of the body, for winding the cord;

a first means for fixing the cord, the first means being frictionally engaged with the cord, the first means including a rectangular-shaped plate, a bottom portion of the rectangular-shaped plate making contact with a bottom wall of the body and a top portion of the rectangular-shaped plate passing through an opening so that the rectangular-shaped plate is arranged to be inclined with respect to the bottom wall of the body, and wherein a hole for withdrawing the cord is formed between the top portion of the rectangular-shaped plate and an upper portion of the opening;

a second means for hingedly supporting the first means;

a third means for biasing the first means to allow the first means to make contact with the cord; and a fourth means for supporting the third means to allow the third means to apply a biasing force to the first means.

2. The vacuum cleaner as claimed in claim 1, wherein the rectangular-shaped plate is integrally formed at a lower portion of a first side thereof with a first hinge pin and is integrally formed at a second side thereof which is opposite to the first side with a second hinge pin.

3. The vacuum cleaner as claimed in claim 1, wherein a semicircular concave portion is formed at a predetermined position of the top portion of the rectangular-shaped plate, for easily releasing the cord from the rectangular-shaped plate.

4. The vacuum cleaner as claimed in claim 1, further comprising a fifth means for releasing a friction between the rectangular-shaped plate and the cord.

5. The vacuum cleaner as claimed in claim 4, wherein the fifth means includes a knob protrudingly formed at an upper portion of a front side of the rectangular-shaped plate.

6. The vacuum cleaner as claimed in claim 5, wherein the second means includes a first fixing rib which is fixed to the bottom wall of the body and a second fixing rib spaced at a predetermined distance apart from the first fixing rib, and the rectangular-shaped plate is hingedly disposed between the first fixing rib and the second fixing rib.

7. The vacuum cleaner as claimed in claim 6, wherein the first and second fixing ribs have a first pin hole and a second pin hole, respectively, at each end portion thereof, and the first and the second pins are hingedly inserted into the first and second pin holes, respectively.

8. The vacuum cleaner as claimed in claim 6, wherein the fourth means includes a supporting rib formed at the bottom wall of the body and spaced by a predetermined distance apart from the rectangular-shaped plate, and a first projection integrally formed at a front side of the supporting rib.

9. The vacuum cleaner as claimed in claim 8, wherein the third means includes a elastic material having a first end portion being fixed to a second projection provided at a rear surface of the rectangular-shaped plate, and a second end portion being fixed to the first projection, the first end portion being opposite to the second end portion.

10. The vacuum cleaner as claimed in claim 6, wherein the upper portion of the opening is inclined laterally in left and right directions from a center thereof by a predetermined angle so that the cord is positioned at the center of the opening.

* * * * *